US009803913B2

(12) United States Patent
Burke et al.

(10) Patent No.: US 9,803,913 B2
(45) Date of Patent: Oct. 31, 2017

(54) TIERED STORAGE SYSTEM FOR REFRIGERATOR DOOR

(71) Applicant: Whirlpool Corporation, Benton Harbor, MI (US)

(72) Inventors: Julia B. Burke, Chicago, IL (US); Daniel Chow, St. Joseph, MI (US); Todd J. Tunzi, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 14/676,916

(22) Filed: Apr. 2, 2015

(65) Prior Publication Data

US 2016/0290707 A1 Oct. 6, 2016

(51) Int. Cl.

*F25D 23/04* (2006.01)
*F25D 23/02* (2006.01)
*F25D 25/02* (2006.01)

(52) U.S. Cl.

CPC ..... *F25D 23/04* (2013.01); *F25D 23/028* (2013.01); *F25D 25/022* (2013.01); *F25D 2331/803* (2013.01); *F25D 2331/805* (2013.01)

(58) Field of Classification Search

CPC ..... F25D 23/02; F25D 23/04; F25D 23/028; F25D 25/022

USPC ..... 312/401, 405, 405.1, 321.5, 348.3; 62/377

See application file for complete search history.

(56) References Cited

U.S. PATENT DOCUMENTS 2,702,639 A * 2/1955 Eck ..... F25D 23/04 211/14
2,955,006 A * 10/1960 White ..... F25D 23/04 211/150
3,220,558 A * 11/1965 Olsson ..... F25D 23/04 211/74
5,685,624 A * 11/1997 Lee ..... F25D 23/04 312/274
7,082,783 B2 8/2006 Uihlein et al.
7,232,194 B2 6/2007 Becke et al.
7,306,302 B2 12/2007 Becke et al.
7,552,983 B2 * 6/2009 Shin ..... F25D 23/04 312/321.5

(Continued)

FOREIGN PATENT DOCUMENTS

JP S60-96579 7/1985
JP 6147742 * 5/1994 ..... F25D 23/04

(Continued)

*Primary Examiner* — James O Hansen
(74) *Attorney, Agent, or Firm* — Diederiks & Whitelaw, PLC

(57) ABSTRACT

A tiered storage system for refrigerator door bins is established by providing an insert between opposing side walls of the bin, with the insert including a raised platform arranged spaced from a bottom wall of the bin. The insert is positioned such that the platform extends only part way from a rear wall to a front wall of the bin and maintained in this operational or in-use position by retainer structure acting between the bin and the insert. The insert also includes an upstanding front panel extending upward from a front end portion of the platform, with the upstanding panel extending between the opposing side walls of the bin, to prevent food containers stored on the platform from toppling upon movement of the refrigerator door.

12 Claims, 3 Drawing Sheets

(56) References Cited

U.S. PATENT DOCUMENTS

| | | | | |
|---|---|---|---|---|
| 7,726,756 | B2 | 6/2010 | Fu | |
| 7,740,331 | B2 | 6/2010 | Koo | |
| 8,220,886 | B2 | 7/2012 | Han et al. | |
| 2004/0183416 | A1* | 9/2004 | Becke | F25D 23/04 312/405.1 |
| 2007/0228908 | A1* | 10/2007 | Eveland | F25D 23/04 312/405.1 |
| 2010/0270902 | A1* | 10/2010 | Kim | F25D 17/042 312/405.1 |

FOREIGN PATENT DOCUMENTS

| | | |
|---|---|---|
| JP | H10 115485 | 5/1998 |
| JP | H10 122733 | 5/1998 |
| JP | 2001074659 A | 3/2001 |

* cited by examiner

TIERED STORAGE SYSTEM FOR REFRIGERATOR DOOR

BACKGROUND OF THE INVENTION

The invention generally pertains to the art of refrigerated appliances and, more particularly, to a system for storing food items in a tiered manner on a door of a refrigerator.

It is well known in the art of refrigerated appliances to provide structure on inner liners of fresh food and freezer doors to support shelving units for retaining various food containers. Often the shelving units take the form of fixed or removable bins that are incorporated onto the door liner. The bins can be arranged at various positions on the inner liner to provide spacing to accommodate food containers having varying heights.

Certainly, the food containers must be adequately retained so as to prevent unnecessary toppling when the refrigerator door is opened or closed. To address this concern, certain bins are actually made quite deep, such as in the order of 4-6 inches (approximately 10-15 cm), to accommodate tall items. With such depths, smaller containers stored in a bin can become obscured. That is, depending on the height of a given container and the labeling thereon, the contents can be visually blocked by the front or side walls of the bin, or other containers. Although it is possible to raise the heights of containers relative to upper rims of storage bins, such as by employing more shallow bins, a variety of bin depths is desirable given the vast range of container sizes to be potentially stored. In any case, generally providing more shallow bins just brings the toppling issue more to the forefront.

SUMMARY OF THE INVENTION

The present invention is directed to providing for tiered storage in connection with bins provided on refrigerator doors. In accordance with one form of the invention, an insert is provided for a bin, with the insert extending between opposing side walls of the bin and establishing a platform arranged spaced from a bottom of the bin. The insert is positioned such that the platform extends only part way from a rear wall to a front wall of the bin and maintained in this operational or in-use position by retainer structure acting between the bin and the insert. With this arrangement, the insert divides the storage region of the bin into a frontal portion which provides for a first level of storage, while the raised platform of the insert establishes a rear storage region providing for storage at a second level for the bin.

In order to assure that the containers supported on the raised platform of the insert will not topple from the bin when the refrigerator door is opened or closed, an upstanding front panel extends from a front end portion of the platform, with the upstanding panel extending between the opposing side walls of the bin. With the above construction, a tiered storage system is established for the bin, thereby enhancing the visibility of smaller food item containers stored in the bin. At the same time, the stored food containers are protected from toppling upon movement of the refrigerator door.

Additional objects, features and advantages of the invention will become more readily apparent from the following detailed description when taken in conjunction with the drawings wherein like reference numerals refer to corresponding parts in the several views.

DETAILED DESCRIPTION OF INVENTION

Figure 1:
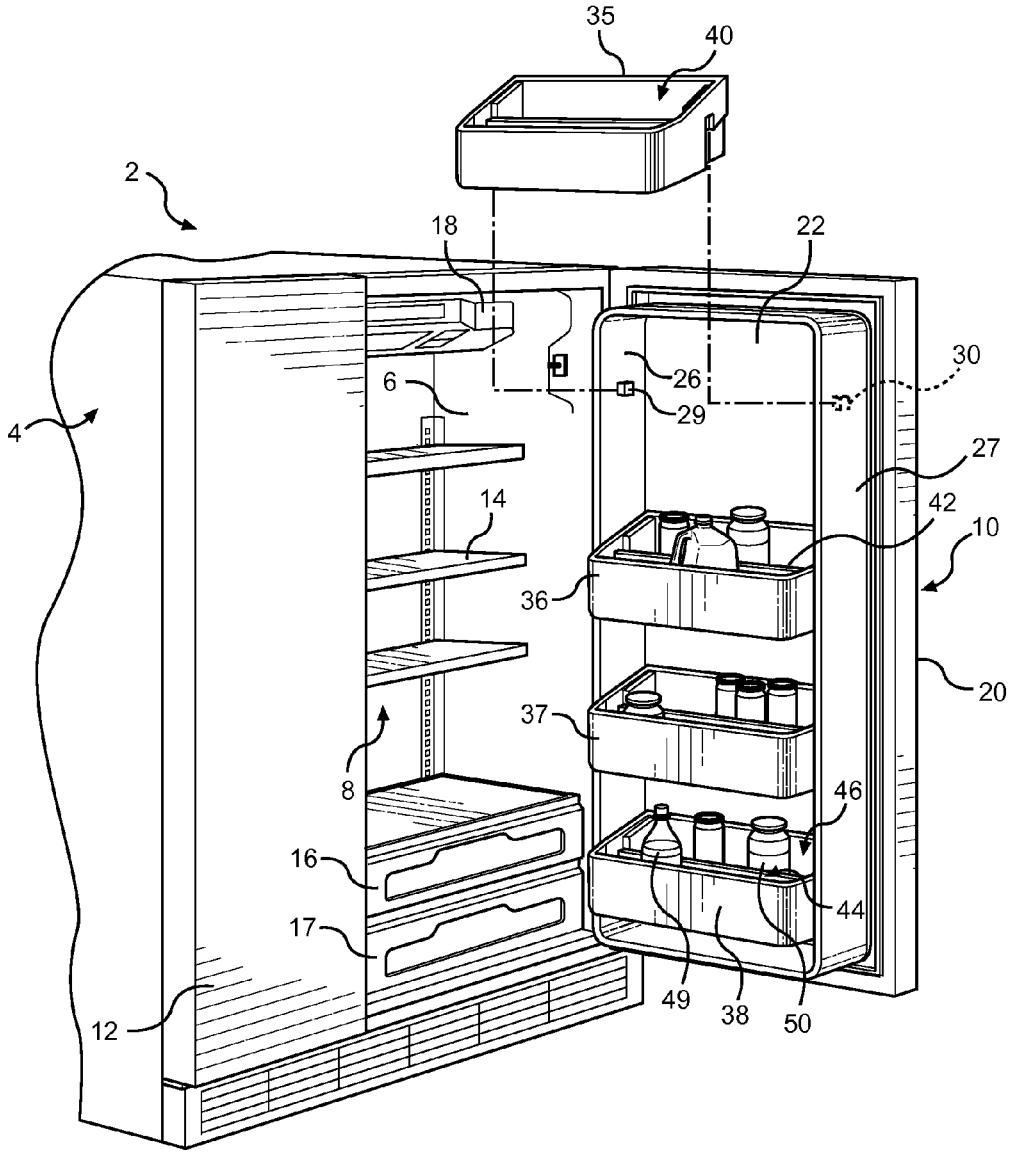
FIG. 1 is a partial, perspective view of a side-by-side refrigerator including a tiered storage system in accordance with the invention.

With reference to FIG. 1, a side-by-side refrigerator 2 is shown including a cabinet shell 4 within which is positioned a liner 6 that defines a fresh food compartment 8. In a manner known in the art, fresh food compartment 8 can be accessed by the selective opening of a fresh food door 10. In a similar manner, a freezer door 12 can be opened to selectively access a freezer compartment (not shown). In the embodiment illustrated, fresh food compartment 8 is provided with a plurality of vertically spaced shelves, one of which is indicated at 14, along with multiple, slidably mounted drawers 16 and 17. Also illustrated in FIG. 1 is a control housing 18 arranged in an upper portion of fresh food compartment 8. In a manner known in the art, control housing 18 is provided to regulate the operation of a refrigeration system (not shown) used to establish a desired refrigeration temperature within refrigerator 2.

As depicted, fresh food door 10 includes an outer shell 20 and an inner door liner 22. Inner door liner 22 includes dike portions 26 and 27 which are shown to be integrally molded with a plurality of vertically spaced support members, a pair of which is indicated at 29 and 30. Each pair of support members 29 and 30 is used to mount a respective bin 35-38, each of which defines a storage region 40. In accordance with the invention, one or more of bins 35-38 is provided with an insert 44 which divides storage region 40 into a frontal portion 44 and a rear portion 46 for supporting food containers 49 and 50 respectively, while also establishing a tiered storage assembly as will be detailed more fully below.

Figure 2:
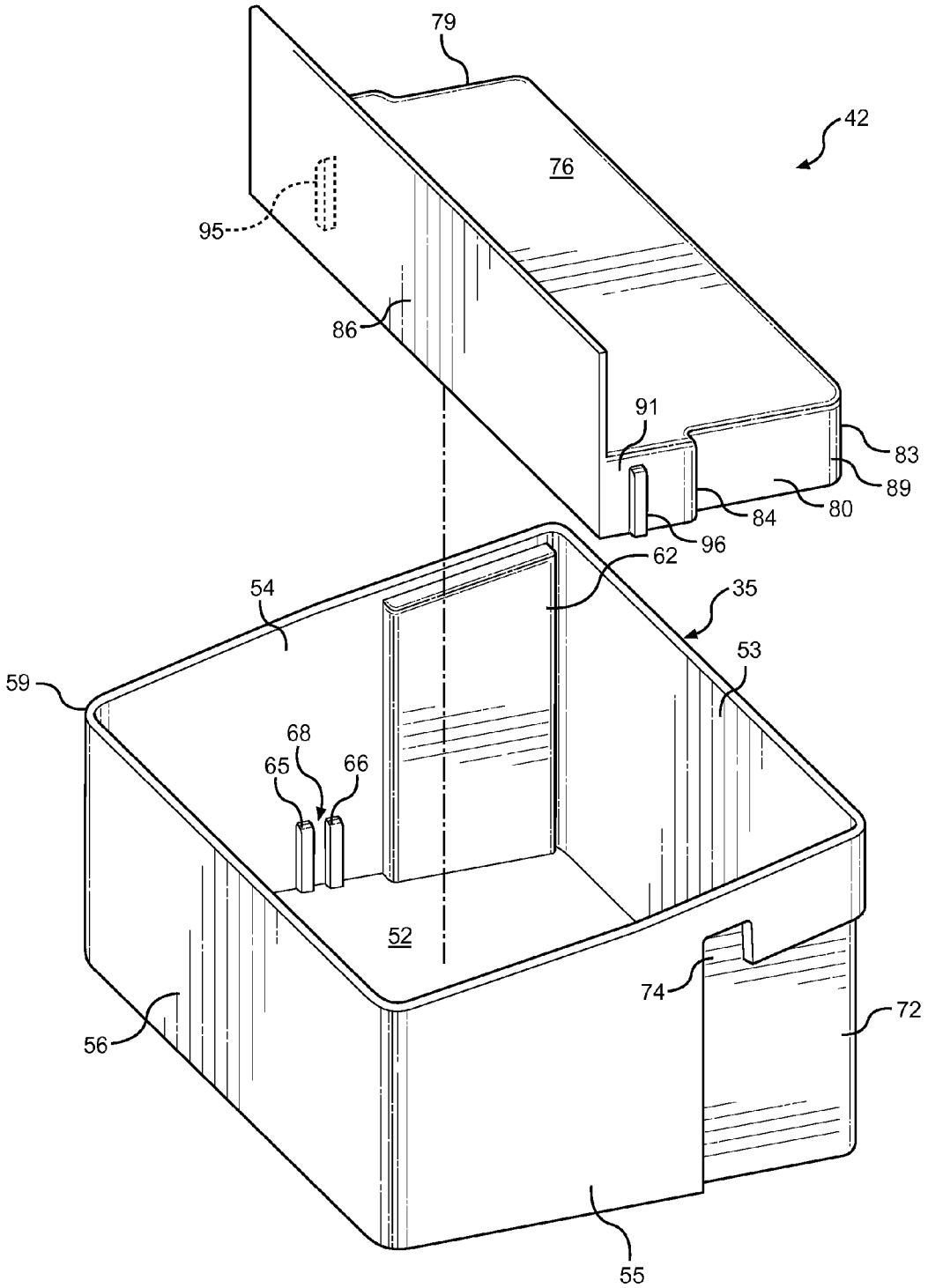
FIG. 2 is an enlarged, exploded perspective view of a bin and insert combination establishing the tiered storage system of FIG. 1.
Figure 3:
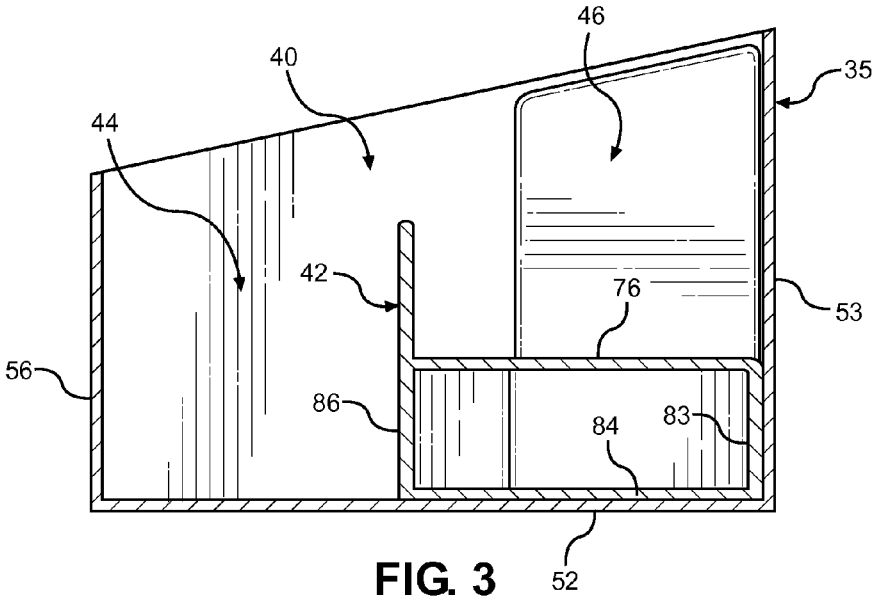
FIG. 3 is a cross-sectional view of the tiered storage system of FIG. 2.
Figure 4:
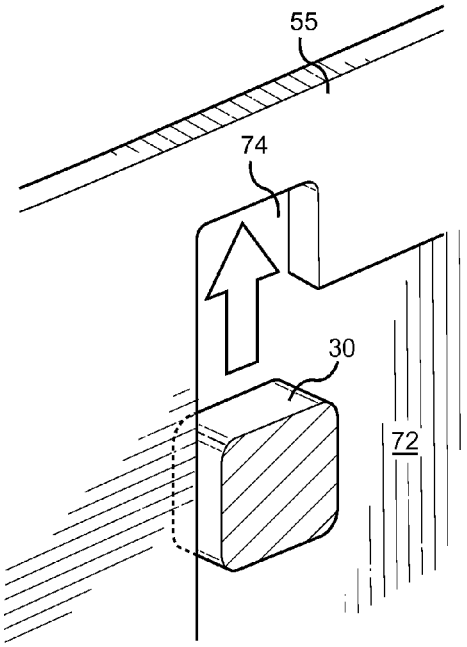
FIG. 4 is a partial cross-sectional view illustrating a mounting arrangement for the bin of FIG. 2 within the refrigerator of FIG. 1.

Reference will now be made to FIGS. 2 and 3 in describing an exemplary embodiment of the tiered storage assembly in connection with bin 35 and insert 42. As shown, bin 35 includes a bottom wall 52, a back wall 53, opposing side walls 54 and 55, and a front wall 56 that collectively define storage region 40. In a preferred form of the invention, bin 35 is integrally molded of plastic and includes rounded corners, such as corner 59 between front wall 56 and side wall 54. Bin 35 is also shown to be formed with opposing internal columns, one of which is shown at 62 for side wall 54, as well as a set of upstanding guide rail members 65 and 66 extending from bottom wall 52 and along a respective one of opposing side walls 54 and 55. As depicted, the set of guide rail members 65 and 66 are spaced by a gap which is generally indicated at 68. On the outside of each side wall 54, 55, in opposition to internal column 62, is established a slotted or recessed region 72 which leads to a catch or notch portion 74. With further reference to FIGS. 1 and 4, when bin 35 is to be supported from door 10, bin 35 is positioned between dike portions 26 and 27, with support members 29 and 30 being received in the slotted regions 72 in opposing side walls 54 and 55. Bin 35 is then maneuvered such that each support member 29, 30 is directed into a respective catch portion 74. With this arrangement, bin 35 rests on support members 29 and 30 but can be readily lifted and removed from upon liner 6 of door 10.

Figure 5:
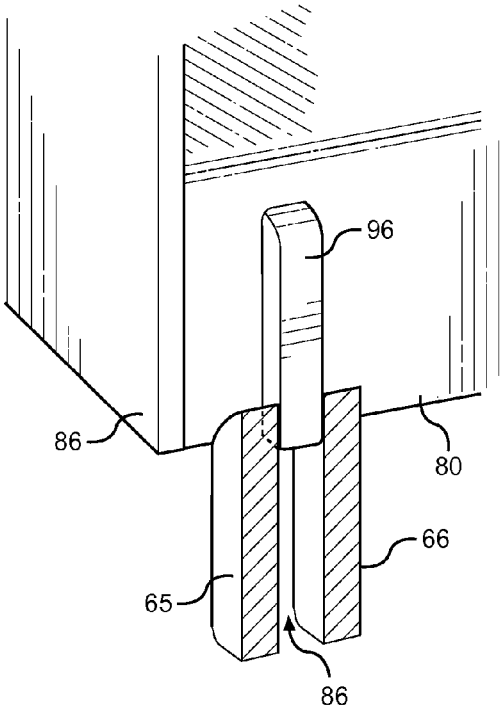
FIG. 5 is a partial cross-sectional view illustrating retainer structure acting between the bin and the insert of FIG. 2.

As also shown in FIGS. 2 and 3, insert 44 includes a platform 76, base side walls 79 and 80, a rear wall 83, a bottom wall 84 and an upstanding front panel 86. As with bin 35, insert 42 is also preferably integrally molded of plastic. Each side wall 79, 80 includes a rear section 89 and a front section 91, with front section 91 projecting laterally outwardly of rear section 89. In addition, provided on each side wall 79, 80 of insert 42 is a respective tab element 95, 96. When insert 42 is placed within bin 35 to establish frontal portion 44 and rear portion 46 for storage region 40, side walls 79 and 80 conform to the contour of opposing side walls 54 and 55 and accommodate internal columns 62. At the same time, each tab element 95, 96 aligns with the gap 68 between a respective set of guide rail members 65 and 66 as best shown in FIG. 5.

Based on the above, it should be readily apparent that the invention provides for a tiered storage assembly with an insert being securely retained within only a rear portion of a door storage bin while establishing a raised display platform. Therefore, the invention advantageously enables large food containers, such as container 49, to be retained in frontal portion 44 of storage region 40, while smaller food items, such as container 50, can be positioned upon platform 76, behind front panel 86. With this arrangement, smaller food items can be supported in a raised manner so as to be more visually accessible. At the same time, front panel 86 assures that the smaller food items, such as container 50, will not topple over when door 10 is opened and closed. As represented by the configuration shown in FIG. 3, front panel 86 preferably projects above platform 76 to a height less than front wall 56 to enhance access to the smaller containers 50, while still fully accomplishing its container retention function.

Although disclosed with reference to preferred embodiments of the invention, it should be readily apparent that various changes and modifications can be made to the invention. For instance, the overall structure of the bin and insert could vary without departing from the invention. By way of example, the bin need not include a rear wall, but instead the liner could be employed to partially define the storage region. In addition, the insert could be constructed differently, such as without either a rear or bottom wall. Furthermore, other bin supporting and insert retaining structure could be utilized without departing from the spirit of the invention.

The invention claimed is:

1. A refrigerator comprising:

a cabinet establishing a refrigerated compartment;

a door mounted to the cabinet for providing access to the refrigerated compartment, said door including an inner liner; and a tiered storage assembly including:

a storage bin including at least a bottom wall, a front wall and opposing side walls that collectively define a storage region, said storage bin being mounted on the inner liner for movement with the door; and an insert supported on the bottom wall of the bin, extending between the opposing side walls of the bin and terminating before the front wall of the bin so as to divide the storage region into a frontal portion and a rear portion, with the insert including a raised platform which is spaced from the bottom wall of the bin, wherein the bottom wall of the bin provides for a first level of storage in the frontal portion of the bin, while the raised platform of the insert provides for a second level of storage in the rear portion of the bin and wherein the insert includes a rear wall portion extending downward from a rear end portion of the platform to support the insert directly from the bottom wall of the storage bin, a front panel extending upward from a front end portion of the platform, with the front panel preventing food containers positioned on the platform from toppling when the door is opened and closed, and a bottom panel spaced from the raised platform and extending forward from the rear wall portion of the insert.

2. The refrigerator according to claim 1, wherein the front panel projects above the platform but to a height less than the front wall of the bin.

3. The refrigerator according to claim 1, wherein the rear portion of the storage region is established by the platform, the front panel, the opposing side walls of the bin and a back wall of the bin.

4. The refrigerator according to claim 1, wherein the inner liner includes opposing dike portions, with each one of the dike portions including a support member projecting toward another one of the dike portions, and wherein each of the opposing side walls of the bin is formed with a slotted region including a catch portion, said bin being supported between the dike portions on the door with each said support member being received within a respective said slotted region and retained in a respective said catch portion.

5. A refrigerator comprising:

a cabinet establishing a refrigerated compartment;

a door mounted to the cabinet for providing access to the refrigerated compartment, said door including an inner liner; and a tiered storage assembly including:

a storage bin including at least a bottom wall, a front wall and opposing side walls that collectively define a storage region, said storage bin being mounted on the inner liner for movement with the door;

an insert supported on the bottom wall of the bin, extending between the opposing side walls of the bin and terminating before the front wall of the bin so as to divide the storage region into a frontal portion and a rear portion, with the insert including opposing side portions, a raised platform which is spaced from the bottom wall of the bin, wherein the bottom wall of the bin provides for a first level of storage in the frontal portion of the bin, while the raised platform of the insert provides for a second level of storage in the rear portion of the bin; and retainer structure acting between the side walls of the bin and the insert for retaining the insert in the rear portion of the storage region, wherein the retainer structure includes a member projecting from one of the opposing side walls of the bin and an element projecting from one of the opposing side portions of the insert, with the member being located closer to the front wall than the element to retain the insert in the rear portion of the storage region when the member is engaged with the element.

6. The refrigerator according to claim 5, wherein the retainer structure further includes another member projecting from the same opposing side wall of the bin as the member so as to form a pair of members, with the members being spaced fore-to-aft, and wherein the element is a tab element being slidably received between the pair of spaced members.

7. The refrigerator according to claim 5, wherein the member is a guide rail member the element is a tab element.

8. A tiered storage assembly for a refrigerator door including:

a storage bin including at least a bottom wall, a front wall and opposing side walls that collectively define a storage region, said storage bin being configured for mounting on an inner liner of a refrigerator door for movement with the door;

an insert supported on the bottom wall of the bin, extending between the opposing side walls of the bin and terminating before the front wall of the bin so as to divide the storage region into a frontal portion and a rear portion, with the insert including a raised platform which is spaced from the bottom wall of the bin, wherein the bottom wall of the bin provides for a first level of storage in the frontal portion of the bin, while the raised platform of the insert provides for a second level of storage in the rear portion of the bin and wherein the insert includes a rear wall portion extending downward from a rear end portion of the platform to support the insert directly from the bottom wall of the storage bin and a front panel extending upward from a front end portion of the platform, with the front panel preventing food containers positioned on the platform from toppling when the door is opened and closed; and retainer structure acting between the bin and the insert for retaining the insert in the rear portion of the storage region, wherein the retainer structure includes a pair of fore-to-aft spaced guide rail members on each of the opposing side walls of the bin and a pair of tab elements provided on opposing side portions of the insert, with a respective one of the tab elements being slidably received between the pair of spaced guide rail members and respective ones of the guide rail members and tab elements being engaged when the insert is mounted in the bin.

9. The tiered storage assembly according to claim 8, wherein the front panel projects above the platform but to a height less than the front wall of the bin.

10. The tiered storage assembly according to claim 8, wherein the rear portion of the storage region is established by the platform, the front panel, the opposing side walls of the bin and a back wall of the bin.

11. A method of storing food containers on a door of a refrigerator comprising:

supporting at least one food container in a frontal portion of a storage region established in a bin mounted on a liner of the refrigerator door and including at least a bottom wall, a back wall, a front wall and opposing side walls that collectively define the storage region;

supporting at least one other food container on a platform of an insert supported on the bottom wall of the bin, extending between the opposing side walls of the bin and terminating before the front wall of the bin so as to divide the storage region into the frontal portion and a rear portion, wherein the platform is raised so as to be spaced from the bottom wall of the bin such that the at least one food container is supported on the bottom wall of the bin at a first level of storage in the frontal portion of the bin and the at least one other food container is supported on the platform of the insert at a second, higher level of storage in the rear portion of the bin; and retaining the insert, which includes opposing side portions, within the rear portion of the storage region of the bin by interengaging a member projecting from one of the opposing side walls of the bin with an element projecting from one of the opposing side portions of the insert, with the member being located closer to the front wall than the element to retain the insert in the rear portion of the storage region.

12. The method of claim 11, wherein another member projects from the same opposing side wall of the bin as the member to form a pair of guide rail members, with the guide rail members being spaced fore-to-aft, the element is a tab element, and wherein retaining the insert within the rear portion of the storage region of the bin further comprises slidably and snugly receiving the tab element between the pair of fore-to-aft spaced guide rail members.

* * * * *